United States Patent [19]

Thompson

[11] Patent Number: 4,484,780

[45] Date of Patent: Nov. 27, 1984

[54] LEG REST HANGER

[75] Inventor: Chadwick B. Thompson, Auckland, New Zealand

[73] Assignee: W. A. Thompson & Company Limited, New Zealand

[21] Appl. No.: 311,237

[22] Filed: Oct. 14, 1981

[51] Int. Cl.[3] ..... A47C 7/52

[52] U.S. Cl. ..... 297/433; 297/423; 297/DIG. 4

[58] Field of Search ..... 297/423, 433, 436, DIG. 4, 297/192, 437, 438, 439; 280/289 WC, 242 WC

[56] References Cited

U.S. PATENT DOCUMENTS

| | | | |
|---|---|---|---|
| 2,746,527 | 5/1956 | Liebich | 297/433 |
| 2,818,910 | 1/1958 | Hawkins | 297/DIG. 4 |
| 3,679,257 | 7/1972 | Jacuzzi et al. | 297/433 |
| 3,833,256 | 9/1974 | Dehner | 297/433 |
| 3,891,268 | 6/1975 | Taylor | 297/DIG. 4 |
| 3,968,991 | 7/1976 | Maclaren | 297/DIG. 4 |
| 4,164,354 | 8/1979 | Rodaway | 297/DIG. 4 |
| 4,384,732 | 5/1983 | Wierwille | 280/289 WC |

FOREIGN PATENT DOCUMENTS

| | | | |
|---|---|---|---|
| 1039172 | 9/1978 | Canada | 297/DIG. 4 |

*Primary Examiner*—William E. Lyddane
*Assistant Examiner*—Mark W. Binder
*Attorney, Agent, or Firm*—Cantor and Lessler

[57] ABSTRACT

The invention relates to a structure that may very simply be fitted to and removed from a wide variety of patterns of wheelchair. The structure supports a leg rest that may be a simple horizontal foot rest for a person sitting in a conventional position, be tilted so as to lift the toes in relation to the heels, may support a rigid leg, or be tilted to the vertical so as not to obstruct a person moving from sitting in the wheelchair to standing on the ground.

The foot rest projects forward a lesser distance than does the conventional footrest.

10 Claims, 3 Drawing Figures

LEG REST HANGER

BACKGROUND OF THE INVENTION

This invention relates to a leg rest hanger for use on wheelchairs.

In the past wheelchairs have traditionally been provided with leg rests pivoted to the front corners of the wheelchair. This arrangement has a number of disadvantages.

For example, the leg rest is a forward extension which limits the turning circle of the wheelchair, and is prone to bump into objects which the wheelchair is brought close to. Secondly, a person whom the occupant of a wheelchair is approaching is made more conscious of the wheelchair because part of the wheelchair is readily visible in front of its occupant. This can emphasize the occupant's disability, both to himself and to the other person.

The object of the present invention is to go some way to overcoming the above disadvantages.

BRIEF SUMMARY OF THE INVENTION

Accordingly in a first aspect the invention consists in a leg rest hanger adapted to be fitted to a wheelchair which has cross brace members under the seat and side frame members also under the seat, wherein a connector joins together the cross bracing members and the leg rest hanger is adapted to be supported by the connector, wherein side arms attached to the leg rest hanger extend to at least a side frame member on each side of the wheelchair, whereby the lateral position of the leg rest hanger is fixed relative to the wheelchair, and wherein the leg rest hanger supports and fixes laterally a footrest on which the occupant of the wheelchair may rest his or her legs or feet.

In a second aspect the invention consists in a wheelchair comprising a frame, wheels supporting the frame, and a seat mounted on said frame including a pair of cross bracing members under the seat, a pin or bolt securing said cross bracing members together, and means at or adjacent to the junction of said cross bracing members whereby a leg rest hanger can be attached to the wheelchair.

In a third aspect the invention consists in a wheelchair provided with a leg rest hanger as defined above.

BRIEF DESCRIPTION OF THE DRAWINGS

The above gives a broad description of the present invention, a preferred form of which will now be described by way of example with reference to the accompanying drawings in which.

DETAILED DESCRIPTION OF THE INVENTION

Figure 1:
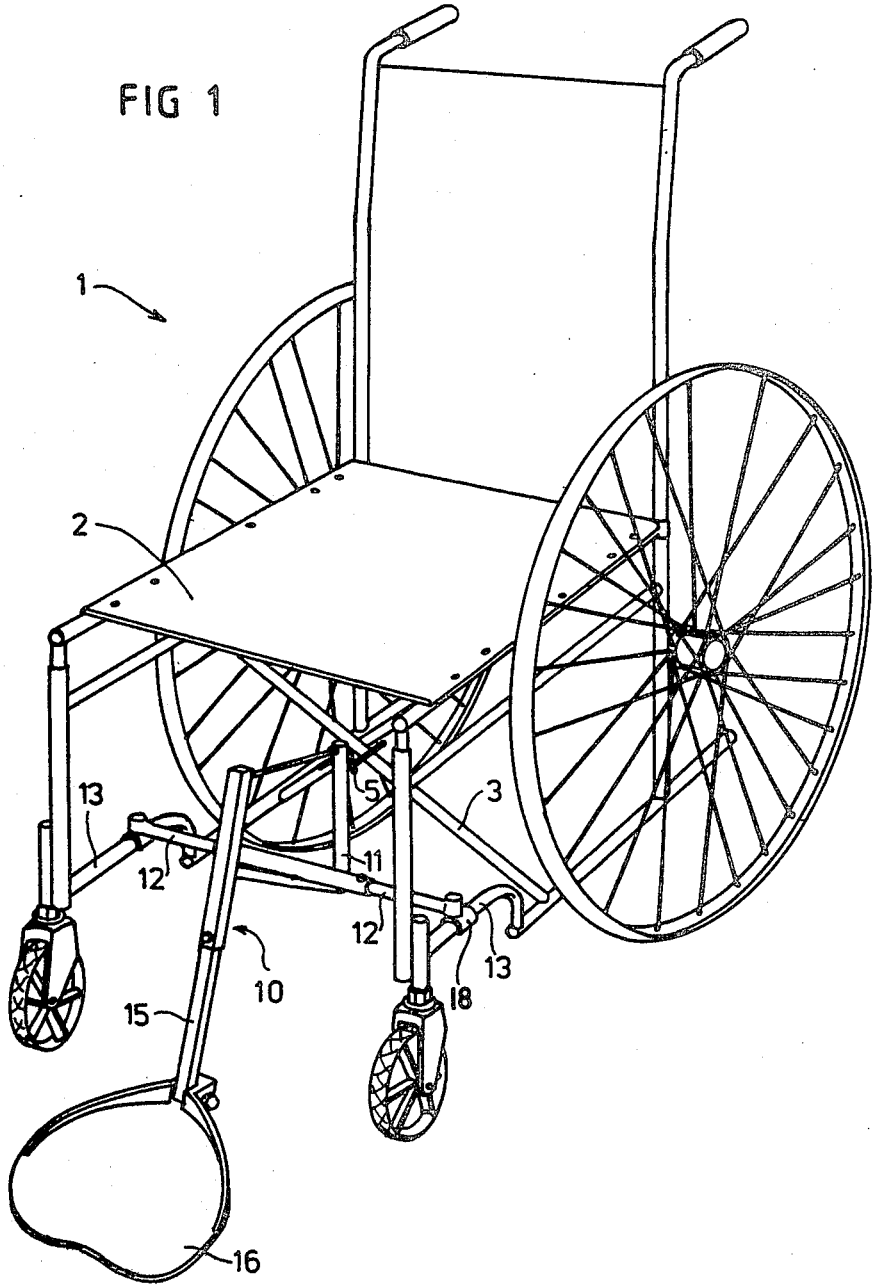
FIG. 1 is a general view of a wheelchair provided with a leg rest hanger according to the present invention.
Figure 2:
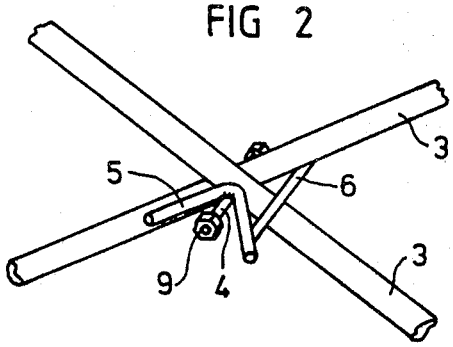
FIG. 2 is a detail of part of the wheelchair of FIG. 1.
Figure 3:
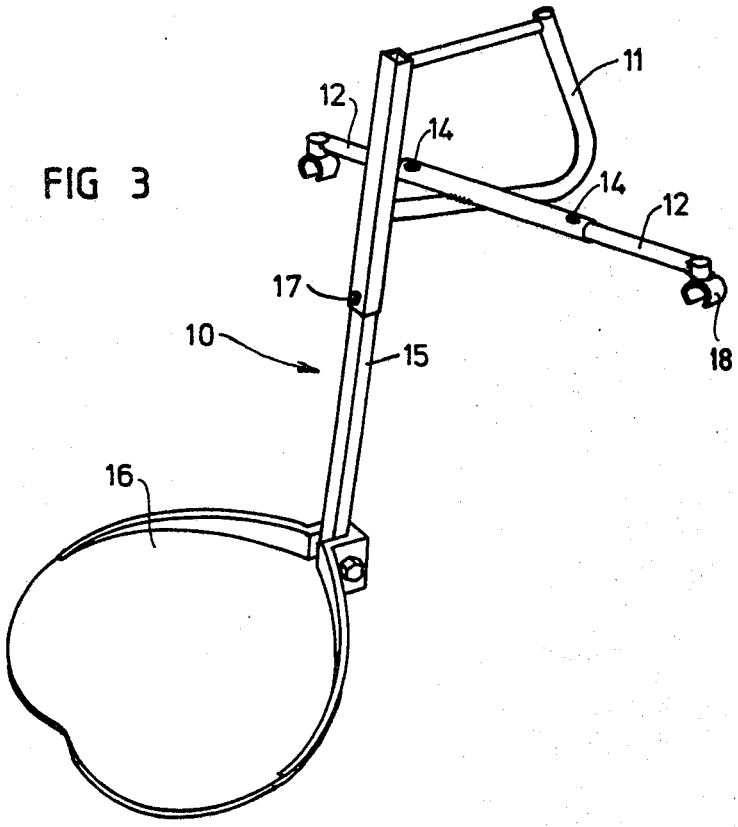
FIG. 3 is a perspective view of the leg rest hanger according to the present invention.

Referring now to the drawings, wheelchair 1 includes a seat 2 and a pair of cross bracing members 3 under the seat. The cross bracing members 3 are shown in detail in FIG. 2 where it can be seen that they are pivotally connected together for example by a pin or bolt 4. Some details of the wheelchair not relevant to the present invention, such as arm rests, have been omitted to simplify the drawings. The guide 5 whose purpose will be explained later is welded or otherwise attached to bolt 4 and rod 6 which passes between two cross bracing members 3 prevents guide 5, which is used in a horizontal position, from rotating towards the vertical. The head 9 of the bolt 4 is clear of cross bracing members 3 and guide 5.

Attached to the top of leg rest hanger 10 is a frame or strut 11 which may conveniently be made of rod or tube. In use it supports the leg rest hanger 10 from bolt head 9. At the top of member 11 is a substantially key hole shaped aperture, (not shown). Bolt head 9 can be inserted through the wide portion of the key hole shaped aperture, and then member 11 is slid vertically so that the neck of the bolt passes along the narrow portion of the slot and the hanger 10 is securely engaged by the bolt head.

The fitting of member 11 over bolt head 9 is eased by guide 5. If member 11 is pushed into this guide it will be steered towards the position at which the key hole slot (not shown) fits over bolt head 9. Alternatively the fitting of member 11 over bolt head 9 may be eased by an arrangement other than the V-guide 5. Instead bolt head 9 is made conical so that the keyhole slot is easily located on it. In effect bolt head 9 acts as its own guide.

Extending sideways from leg rest hanger 10 is a pair of side arms 12, the ends of which are shaped to fit onto the side members 13 of the wheelchair. The side arms 12 are adjustable in length so that the leg rest hanger may be fitted to wheelchairs of varying sizes and each end of a side arm 12 is a saddle 18 adapted to fit over a side member 13 and to stabilize the leg rest 16 in the direction across the wheelchair.

Leg rest hanger 10 is telescopic. The lower and inner part 15 has pinned to the bottom end of it a foot rest, which may conveniently be a foot plate, 16. It is adjustable in height to suit different lengths of leg, by telescoping strut 15 and clamping it by screw or bolt 17. Also the angle at which the foot plate extends out from the strut 15 can be adjusted so that the occupant's feet are firmly supported at a comfortable angle. However the foot plate can be pivoted up to a vertical position so that it is out of the way of the occupant's feet should he or she want to move forward off the wheelchair or backwards onto it.

Around the edge of the foot plate which is nearest to the chair is fitted a rim so that the occupant's feet will not easily slip off the foot plate in use.

Thus the present invention provides a leg rest hanger which can readily be fitted to or removed from a wheelchair. Many modifications to the above may be made without departing from the scope of the invention as broadly defined. For example, the foot plate strut 15 and foot plate 16 can be replaced by a forwardly extending strut and support plate suitable for supporting a patient's leg straight out in front of him, as for example when the wheelchair is occupied by a patient with one or both of his legs in plaster so that he cannot bend his knees.

Various means of attaching the back of the leg rest hanger to the junction of the cross bracing members may be employed. Also, various forms of guide may be used to assist the positioning of the leg rest hanger on the cross bracing. Also various means of attaching the guide to the cross bracing are possible. If desired, the guide can be dispensed with altogether.

The side arms 12 can be arranged so that instead of resting on the lower side members 13 of the wheelchair they may rest on some other portion of the wheelchair to hold the leg rest hanger steady. However the arrangement shown is that which is preferred.

The side arms 12 can be arranged to fold up so that, when the wheelchair is collapsed for stowage in a vehicle or the like, the leg rest hanger need not be removed, but can be folded up with it. In this arrangement, the leg rest hanger can be more permanently attached to the wheelchair.

I claim:

1. A leg rest hanger for use with a wheelchair having cross-bracing members under the wheelchair seat, a connector which comprises a bolt having a projecting head, for joining the cross-bracing members and supporting the leg rest hanger, and side frame members under the seat, said leg rest hanger comprising:

side arms for extending to said side frame members to fix the lateral positon of the leg rest hanger with respect to the wheelchair;

a foot rest supported and fixed laterally by said leg rest hanger upon which the lower limbs of an occupant of the wheelchair may be rested; and an aperture in said hanger for receiving the head of said bolt to secure the hanger to the connector and allow removal of the hanger from the wheelchair.

2. A leg rest hanger as claimed in claim 1 wherein the foot rest comprises a foot plate partially surrounded by a rim.

3. A leg rest hanger as claimed in claim 1 wherein the footrest is pivotable between an operative position in which it is adapted to support the occupant's lower limbs, and a retracted position in which the space normally occupied by the occupant's lower limbs is left substantially clear.

4. A leg rest hanger as claimed in claim 1 wherein the position of the foot rest in its operative position is adjustable.

5. A leg rest hanger as claimed in claim 1 wherein the side arms are adjustable in length whereby the foot rest hanger is adapted to be fitted to a variety of patterns of wheelchair.

6. A leg rest hanger as claimed in claim 1 wherein said connector further comprises guide means to facilitate the insertion of the head of the bolt into the aperture.

7. A wheelchair as claimed in claim 6 wherein said guide means comprises a V-shaped member located on said bolt.

8. A wheelchair as claimed in claim 6 wherein said guide means is provided with a stabilising means to hold the guide means in a guiding position.

9. A wheelchair as claimed in claim 6 wherein said guide means comprises a conical shaping of the head of the bolt.

10. A wheelchair, comprising:

a seat;

cross-bracing members under the seat;

a connector comprising a bolt having a projecting head for joining the cross-bracing members;

side frame members under the seat;

a leg rest hanger supported by said connector, comprising;

side arms extending to said side frame members to fix the lateral position of the leg rest hanger with respect to the wheelchair, a foot rest supported and fixed laterally by said leg rest hanger upon which the lower limbs of an occupant of the wheelchair may be rested; and an aperture in said hanger for receiving the head of said bolt to secure the hanger to the connector and allow removal of the hanger from the wheelchair.

* * * * *